United States Patent [19]

Cirami

[11] Patent Number: 4,830,603

[45] Date of Patent: May 16, 1989

[54] CHILD-RESISTANT DISPOSABLE LIGHTER

[76] Inventor: Salvatore Cirami, 12-21 35th Ave., Apt. 4F, Long Island City, N.Y. 11106

[21] Appl. No.: 244,149

[22] Filed: Sep. 14, 1988

Related U.S. Application Data

[63] Continuation-in-part of Ser. No. 164,329, Mar. 4, 1988, abandoned.

[51] Int. Cl.[4] ..... F23D 11/36

[52] U.S. Cl. ..... 431/153; 222/153; 222/402.11; 431/277; 251/102; 251/95

[58] Field of Search ..... 431/153, 255, 277, 267, 431/131, 253; 222/153, 402.11; 251/95, 102, 104, 321

[56] References Cited

U.S. PATENT DOCUMENTS

| | | | |
|---|---|---|---|
| 3,938,943 | 2/1976 | Malamoud | 431/150 |
| 4,324,351 | 4/1982 | Meshberg | 222/402.11 |
| 4,432,542 | 2/1984 | Puynter | 431/254 X |

*Primary Examiner*—Randall L. Green

[57] ABSTRACT

A child-resistant disposable lighter has its pushbutton normally locked and requires the user to move a safety release bidirectionally in order to unlock the pushbutton for operation in the conventional way. The lighter's housing includes a second compartment appended to but otherwise isolated from the fuel compartment, the second compartment having an open upper end. The pushbotton has an underside portion that overhangs and is depressible into the open upper end of the second compartment. A safety spring anchored at a lower end in the second compartment has its upper end providing a probe that extends into a channel formed in the underside of the pushbotton. The safety release is accessible at a side of the housing and is moved first inboard and then rearward and then released so that it returns to a given intermediate position, such movements effecting corresponding movements of the probe within the channel whereby the pushbutton is unlocked. Depression of the pushbotton causes the probe to return to its initial position and thereby automatically relock the pushbotton. Alternative embodiments provide an opposed pair of safety releases for left-handed/right-handed user convenience.

8 Claims, 4 Drawing Sheets

FIG. 1
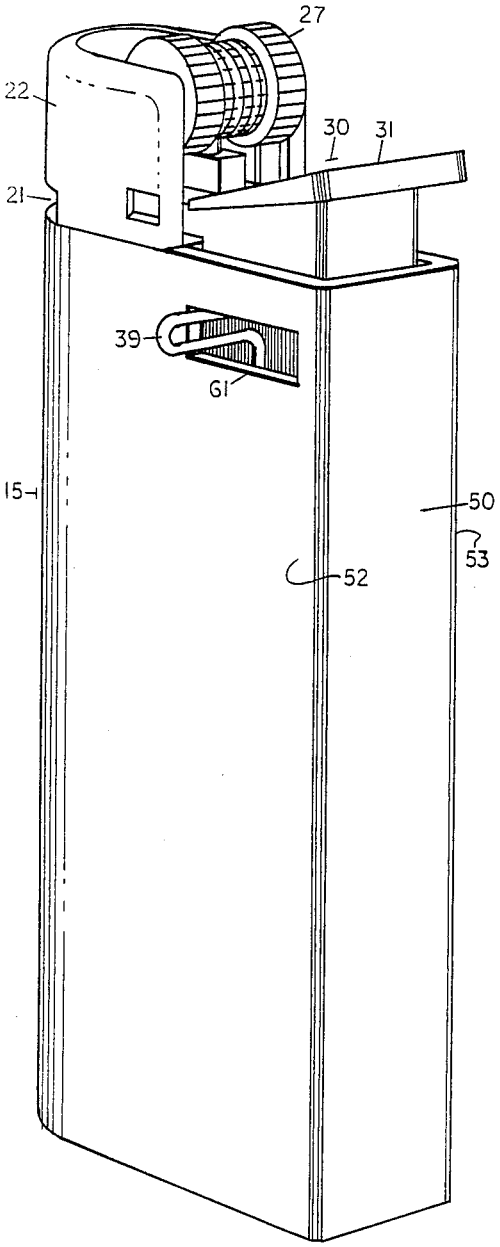
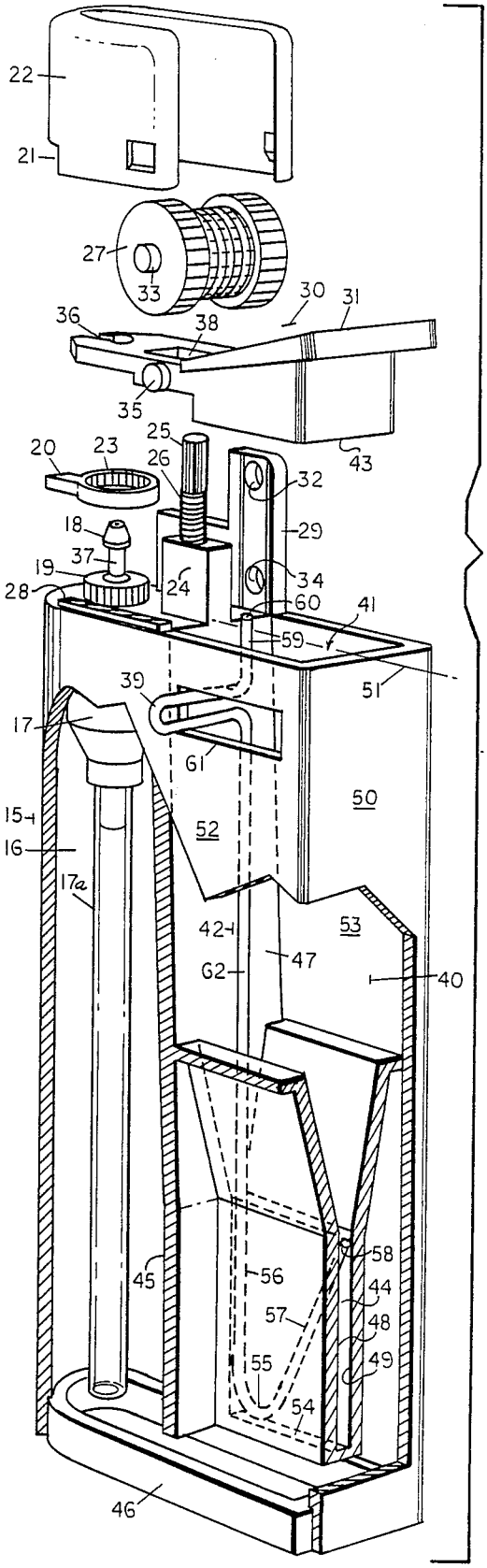
FIG. 2

CHILD-RESISTANT DISPOSABLE LIGHTER

This is a continuation-in-part of an original application Ser. No. 07/164,329, filed Mar. 4, 1988, allowed but abandoned. Benefit of said filing date is claimed with respect to common subject matter.

BACKGROUND OF THE INVENTION

On May 3, 1985, the U.S. Consumer Products Safety Commission (the "CPSC") received a petition requesting the CPSC to begin a rulemaking proceeding to establish requirements applicable to disposable lighters to make such products child-resistant. The petition asserted, among other things, that disposable lighters have been used by children to start fires which have resulted in serious burn injuries and requested the CPSC to issue a rule applicable to disposable lighters which would require more applied pressure to activate such lighters or a multiple-step method for lighting them similar to the procedure required to open some child-resistant packaging.

National fire estimates for the period 1980–1985, indicated that, annually, children playing with cigarette lighters caused on average 7,800 fires resulting in 120 deaths and 750 injuries. Analysis of 277 fire incidents involving children playing with cigarette lighters revealed, among other things, that disposable butane lighters, which account for approximately 95% of the more than 500 million cigarette lighters purchased annually in the United States, were implicated in 96% of those fires in which the type of lighter could be determined, and that the children who operated the lighters were younger than 6 years old—most were 3 or 4 years old. The CPSC is presently engaged in a rulemaking proceeding to establish requirements applicable to cigarette lighters to make them resistant to operation by children.

The present invention provides a child-resistant disposable lighter having a multiple-step mode of operation.

1. Field of the Invention

A common characteristic of the lighters in widest use and consequently most often involved in the fires that of present concern is the presence of a pushbutton that, when depressed, opens valve means that releases the fuel. The most common form of such lighters includes a nonrefillable fuel compartment containing liquid butane under pressure, valve means communicating with the fuel compartment for release of the liquid butane in a gaseous state, a lever the forward end of which is engaged with the valve means and the rearward end of which forms a pushbutton that is biased by spring means maintaining the pushbutton at a given normal elevation—the pushbutton being depressible against the resistance of such spring bias to open the valve means for release of the butane gas, and an ignition system comprising a thumb-operated flint wheel abrading a flint that produces sparks directed toward a nozzle element of the valve means.

This inventor performed an experiment with such a lighter the purpose of which was to determine the necessity of including means covering or locking the flint wheel as part of a child-resistance system—if not, economies could be effected that would increase the likelihood of a child-resistant disposable lighter being manufactured.

For purposes of the experiment, the pushbutton was jammed so that it could not be depressed. A fragment of tissue paper was held between the flint and nozzle element of the valve means and the flint wheel rotated repeatedly. Although directly in the stream of sparks the tissue paper did not catch fire. The conclusion was drawn that since, at least in this experiment, the sparks were unable to ignite tissue paper, it is unlikely that the fires that are of present concern are caused by the sparks per se, and that, therefore, the critical factor must be the pushbutton, the free depressibility of which enables children to produce a flame to cause a fire.

Unlike the flint wheel which generally is more resistive and relatively irritating to operate, it presently requires only light pressure and children find it fun to depress the pushbutton. Even the youngest child not interested in rotating the flint wheel can effect a prolonged release of the combustible gas that may find a source of ignition; and such has occurred in at least one reported incident, with unfortunate consequences.

Clearly, therefore, a child-resistant lighter must provide the pushbutton normally locked and requiring the taking of a prerequisite action not obvious to children in the critical age group in order to unlock the pushbutton.

Accordingly, the field of the present invention pertains generally to lighters having a pushbutton that, when depressed, opens valve means that releases the fuel. Within such field, the invention provides safety means providing the pushbutton normally locked and requiring the user to effect a double-action manipulation of a safety release member (studies have shown that double-action manipulations easily performed by an adult are likely to frustrate young children), the safety release member being located at the side of the lighter where it is substantially concealed during operation of the lighter by an adult and the manipulation performed on the safety release member will be difficult for an observant child to follow.

2. Description of the Prior Art

Although the present improvement is illustrated in the context of that type of lighter most often implicated in the fires that are of present concern, it will be obvious that such improvement is applicable to any lighter wherein the fuel is released in response to depression of a pushbutton.

Three specifically different constructions of disposable butane lighters are known; next referred to as first, second and third types. The first and second types are similar to the extent that the pushbutton element is formed by the rearward end of a pivotally mounted lever the forward end of which is engaged with a nozzle element of the valve means, and, in each case, ignition of the released fuel is effected by rotating a flint wheel against a flint. The distinction between such first and second types pertains to the placement of a spring that biases the valve means normally closed and biases the pushbutton to maintain its normal elevation. The third provides a true pushbutton (meaning that it moves straight up and down) and utilizes an electrical ignition system that is actuated in response to and simultaneously with depression of the pushbutton.

In the first type, the spring extends between the wall structure forming the fuel compartment and the underside of the pushbutton and thereby acts directly upon the pushbutton to push it upwardly, and the pushbutton, through its engagement with the nozzle, keeps the valve means normally closed. The nozzle is otherwise freely movable within a main body portion of the valve means; such main body portion of the valve means being molded integrally with the wall structure forming the fuel compartment. The nozzle is permanently attached to the forward end of the lever and is thereby withdrawable from such main body portion together with the lever (i.e., if one were to remove the pushbutton, the nozzle would come with it).

In the second type, the main body portion of the valve means is molded as a distinct subassembly that is later fixed into place within the wall structure forming the fuel compartment. In this instance, the spring is incorporated within the main body portion of the valve means in an arrangement whereby the nozzle is biased closed and is not removable from such main body portion. The forward end of the lever is snapped onto and is likewise removable from the nozzle without affecting the spring-biased closure of the nozzle. In this second type it is the nozzle element, by virtue of the spring incorporated within the main body portion of the valve means, that biases the pushbutton toward its normal elevation.

Since, in the second type described above, the spring is not placed at the underside of the pushbutton, such underside surface is free. Conventionally, no use is made of such underside surface. When the pushbutton is depressed, its underside surface lowers into a recess provided in the wall structure of the fuel compartment. The second type has an advantage for present purposes in that, since the spring is not placed at the underside of the pushbutton, the underside of the pushbutton is available for modification and use as herein disclosed and thereby enables the provision of a child-resistant lighter according to the present invention that is as slim as the first type of lighter and almost as slim as the second type. For that reason, the present improvement is illustrated in the context of such second type of lighter. (The original application, Ser. No. 07/164,329, shows the improvement embodied in the first type of lighter and the resultant increase in width.)

The invention requires the provision of a second compartment appended to but otherwise distinct from the fuel compartment, such second compartment having an open upper end. The third type of lighter referred to above provides such a compartment, however, it is used to contain a telescoping structure the upper portion of which has a pushbutton fixed to it and the lower portion of which contains a spring and an electrical device that generates an electrical spark in response to depression of the pushbutton. Depression of the pushbutton partially compresses the telescoping sections against the resistance of the spring contained therein, the spring returning the pushbutton to its normal elevation upon release of the pushbutton. In response to depression of the pushbutton, the valve means is opened for release of fuel and at the same time the electrical spark generated arcs over to the nozzle thereby igniting the released gas to produce the flame.

For present purposes it is immaterial whether the lighter utilizes a true pushbutton as in the third type of lighter last described, or a pushbutton that is formed as one end of a lever as in the first and second types of lighters described above. Since, within the context of the present invention, there is no functional distinction between the two types of pushbuttons (and accordingly, the alternative expression "lever or pushbutton" would be permissible to recite in the appended claims), in order to precisely image the element referred to, the term "pushbutton" is recited in the claims and therein refers to a pushbutton formed as one end of a lever and thereby moves arcuately, as well to as a true pushbutton that moves straight up and down.

Finally, the following patents were cited with respect to the original application: U.S. Pat. No. 4,432,542, which pertains to a novelty or "joke" lighter wherein the pushbutton becomes locked in the depressed position for continuous release of a foam-like substance; U.S. Pat. No. 3,938,943, which pertains to a lighter having its lever blocked by a tab that prevents depression of the lever until such tab is broken away subsequent to purchase (to preclude prior accidental depression); and U.S. Pat. No. 4,324,351, which pertains to a pushbutton-type nozzle for a spray container wherein improved stop means is provided for limiting rotation of the pushbutton between alternate dispensing and non-dispensing positions.

No other relevant prior art is known.

SUMMARY OF THE INVENTION

General objects of the invention are to provide a child-resistant disposable lighter—including a fuel compartment, valve means communicating with the fuel compartment for release of fuel and a pushbutton that is spring-biased to maintain a normal elevation and is depressed to open the valve means to release the fuel—wherein the pushbutton is normally locked against depression; having a safety release member that must be moved bidirectionally in order to unlock the pushbutton; wherein such double-action manipulation is simple enough for general acceptance by adults instructed how to do it, but complex enough to frustrate children within the critical age group not so instructed; wherein the pushbutton automatically relocks itself after each and every depression; wherein the safety elements effecting the above cannot be disabled by an adult; and, wherein all of the above is attained at manufacturing cost low enough for incorporation in the lowest priced disposable lighters.

These objects are attained in part by modifying the molded shape of the housing of a conventional disposable lighter to provide a second compartment appended to but distinct from the fuel compartment and having its upper end open; providing the conventional pushbutton having an underside portion overhanging and depressible into the open upper end of such second compartment, the pushbutton having a channel formed therein as below specified; and, providing a safety spring standing in the second compartment and extending into such channel so as to effect an abutment under the pushbutton that maintains it normally locked against depression.

Such second compartment is distinguishable from the prior art in that it is adapted (as specified below) to provide anchorage for a lower portion of the safety spring; and the free underside portion of the pushbutton is distinguishable from the prior art in that (in addition to being provided overhanging a second compartment of the character above indicated) it is provided with an elongated channel formed therein through which the upper end of the safety spring is movable in a hereinafter specified way, the channel effecting a first or "low" ceiling over the second compartment.

More particularly, the safety spring is formed from an initially straight length of stiffly flexible, spring steel wire. The interior of the second compartment is shaped at a lower portion thereof to provide two pairs of opposed wall surfaces forming (together with a bottom wall of the second compartment) a narrow rectangular box. The safety spring is bent to provide a bottom loop, a first arm of which is contiguous and stands vertically with the remainder of the spring (which extends upwardly toward the pushbutton) and the second arm of which diverges from the first and has a free end. The safety spring is permanently anchored in the second compartment by forcible insertion into the rectangular box. The arrangement is such that the second arm of the bottom loop must be partially compressed toward the first in order to effect insertion of the bottom loop between one pair of the opposed walls of the rectangular box, and, after such installation, the sides of the bottom loop are held tightly sandwiched between the other pair of opposed walls of the rectangular box. Subsequent to such installation, any attempt to withdraw the safety spring is prevented by the free end of the bottom loop jamming against the wall surface against which it is forcibly expanded at an appropriate angle with respect thereto.

The upper end of the safety spring is left straight and standing vertically, and it forms a probe having a free end that extends into the channel provided in the underside of the pushbutton, the probe standing normally at a given rest position defining a first point within the channel.

The cross-sectional shape of the channel is generally that of an inverted "U" with the connecting arm of the "U" effecting the first or low ceiling above referred to. The free end of the probe is normally substantially in abutment with such low ceiling so that any attempt made to depress the pushbutton will promptly be blocked by such low ceiling abutting against the free end of the probe. The pushbutton is thereby provided normally locked against depression.

A safety release member operable by one's thumb externally of the lighter's housing is provided extending laterally from the safety spring at an elevation thereon immediately below the probe. In its simplest embodiment, the safety release member is formed by a loop in the wire from which the safety spring is made, the lighter's housing being provided with a slot through which such loop extends. The exposed portion of such loop serves as the safety release member and is pressed inboard and rearward to move the probe through the length of the channel formed in the underside of the pushbutton.

That portion of the safety spring extending between the safety release member and the bottom loop is left straight and vertical and is provided long enough so that its limited flexibility can be drawn upon to impart a strong return bias to the probe whenever the probe is moved away from its rest position.

The invention lighter is held in one hand in the accustomed manner and the safety release member is manipulated using only the thumb of that hand. To unlock the pushbutton the safety release member must be pushed fully inboard, and while holding it fully inboard, pushed fully rearward (the channel being shaped to restrict the probe to bidirectional movement) and then released to allow the probe to return to a given intermediate position within the channel.

More particularly, the channel is shaped so as to require the probe to be moved successively laterally and longitudinally in response to pressing the safety release member inboard and rearward, respectively; the probe being thereby caused to move from its rest position at the first point in the channel to a second point in the channel located furthest from the first, whereat, the channel is shaped so as to stop further movement of the probe. The configuration of the channel so locates the second point that, when the probe is held at such second point, the probe will have imparted to it a combined lateral/longitudinal return bias. Obviously, when released from such second point, the probe will attempt to return to its rest position along a given return bias path.

A third point in the channel is located between the first and second points and in the return bias path of the probe. At this third point, the channel is formed to provide an inside corner that catches the probe when released from the second point and thereby interrupts the return of the probe to its rest position at the first point in the channel.

At such third point the otherwise low ceiling effected by the channel is modified to provide a second or "high" ceiling segment overhanging the inside corner and extending somewhat beyond the inside corner toward the first point in the channel. The high ceiling segment is normally at an elevation above the free end of the probe providing a clearance therebetween sufficient to permit the pushbutton to be depressed provided the probe is caught in the inside corner (at any other location the free end of the probe will be proximate a low ceiling portion of the channel). The pushbutton thereby becomes unlocked whenever the probe stands within the inside corner.

Finally, the channel is formed to provide an L-shaped wedge surface located within and coextensive with the high ceiling segment of the channel and extending angularly from the inside corner to the high ceiling, such that, upon depression of the pushbutton the wedge surface is driven between the probe and inside corner and the probe is thereby forced to move laterally out of the inside corner, whereupon, the probe, under the impetus of its remaining return bias, moves toward the first point in the channel as far as permitted by the high ceiling segment of the channel. Specifically, such return travel is to a fourth point in the channel that is located between the third and first points, outside of the inside corner and immediately adjacent a low ceiling end having common boundary with the high ceiling segment; whereby, when the probe is located at such fourth point, the probe has necessarily circumvented the inside corner but (so long as the pushbutton remains held depressed while the flame is maintained) is stopped by such low ceiling end from completing its return to its rest position at the first point in the channel.

Release of the pushbutton to extinguish the flame returns the channel to its initial elevation. The obstacle previously presented by the above-mentioned low ceiling end is thereby lifted away and that allows the probe to complete its return to its rest position at the first point in the channel. Since such first point is within a low ceiling portion of the channel, the pushbutton is once again locked against depression.

The above has described a complete cycle of operation of the probe. The pushbutton, which was provided normally locked, was, by a bidirectional manipulation of the safety release member caused to become unlocked and thereby depressible, and, depression of the pushbutton caused the pushbutton to automatically relock itself.

It follows from the above that the essence of the present invention resides in the configuration of the channel formed within the pushbutton; the invention being attained in part by and having specific objects including, the provision of any channel configuration characterized by:

a first or low ceiling at an elevation proximate the free end of the probe that blocks depression of the pushbutton when the pushbutton is at its normal elevation;

the rest position or the probe defining a first point within the channel;

a second point therein located furthest from the first, stopping further movement of the probe, accessed by distinct lateral and longitudinal movements of the probe and whereat the probe has a combined lateral/longitudinal return bias imparted to it;

a third point therein located between such first and second points and in the return bias path of the probe;

an inside corner located at such third point and adapted to catch the probe when released from the second point in the channel so as to interrupt return of the probe to the first point in the channel;

a segment providing a second or high ceiling encompassing the inside corner and a fourth point in the channel located (i) between the third and first points, (ii) outside of the inside corner and (iii) immediately adjacent a low ceiling end having common boundary with the high ceiling segment; such high ceiling segment providing clearance over the free end of the probe sufficient to permit the pushbutton to be depressed; and, an L-shaped wedge surface (i) located within and coextensive with the high ceiling segment of the channel, (ii) having a first leg thereof extending angularly from the inside corner to the high ceiling and (iii) having a second leg thereof (x) located outside the inside corner and (y) encompassing the fourth point in the channel—such that, when the pushbutton is depressed, the first leg of such wedge surface drives the probe laterally out of the inside corner and the second leg of such wedge surface allows the probe to move to such fourth point and thereby ensures circumvention or the inside corner.

The original application, Ser. No. 07/164,329, disclosed a single configuration of such channel, repeated herein, having the form of a closed triangular loop. The present disclosure has for further objects the provision of alternative L-shaped and U-shaped channels, the latter duplicating the L-shaped channel on opposite sides of a longitudinal axis and being intended for use with alternative embodiments of the invention lighter providing a pair of opposed safety release members to attain left-handed/right-handed user convenience.

Accordingly, a further object is to provide a first alternative embodiment of the invention lighter for use with a pushbutton having a U-shaped channel according to the present invention, wherein the safety spring has opposed loops forming a pair of opposed safety release members, wherein both side walls of the lighter's housing are provided with a slot, one for each of such loops, and wherein cuts are provided in the housing's side walls to enable insertion of the loops into their respective slots.

And finally, a further object is to provide a second alternative embodiment of the invention lighter for use with a pushbutton having a U-shaped channel according to the present invention wherein the lighter's housing is provided with a notch that extends from one side wall to the other around the rear wall of the housing, and wherein a rectangular block forming a double-sided safety release pushbutton is provided positioned within such notch and securing a snapped-on attachment to the safety spring for movement of same.

BRIEF DESCRIPTION OF THE DRAWINGS

FIG. 1 is general perspective view of a first embodiment of the invention child-resistant lighter which provides a single safety release member.

FIG. 2 is an exploded perspective view of the embodiment of FIG. 1, with portions broken away.

FIG. 5 replaces FIGS. 3 and 4 as the best mode of attainment and preferred embodiment of a closed-loop channel having a generally right-angle triangular configuration for use with the structure of FIGS. 1 and 2.

FIG. 8 showing a portion of the pushbutton sectioned away. The broken-away lower portion of FIG. 8 is identical to that shown in FIG. 1, including the internal structure thereof shown in FIG. 2 which is incorporated into FIG. 8 by reference. Likewise, all components shown in exploded relationship in FIG. 2 are likewise incorporated by reference into the structure of FIG. 8 (the pushbutton being that shown in FIG. 7). FIG. 8 shows the safety spring modified to provide opposed loops effecting an opposed pair of safety release members, both side walls the lighter's housing provided with a slot, one for each loop and the side walls provided with cuts enabling insertion of the loops into their respective slots.

FIG. 9 shows the opposed pair of safety release members given effect by opposite sides of a rectangular plastic block that forms a double-sided, safety release pushbutton. The block secures a snapped-on attachment to the safety spring and is movable within a deep notch provided in the lighter's housing.

DESCRIPTION OF PREFERRED EMBODIMENTS

Figure 3:
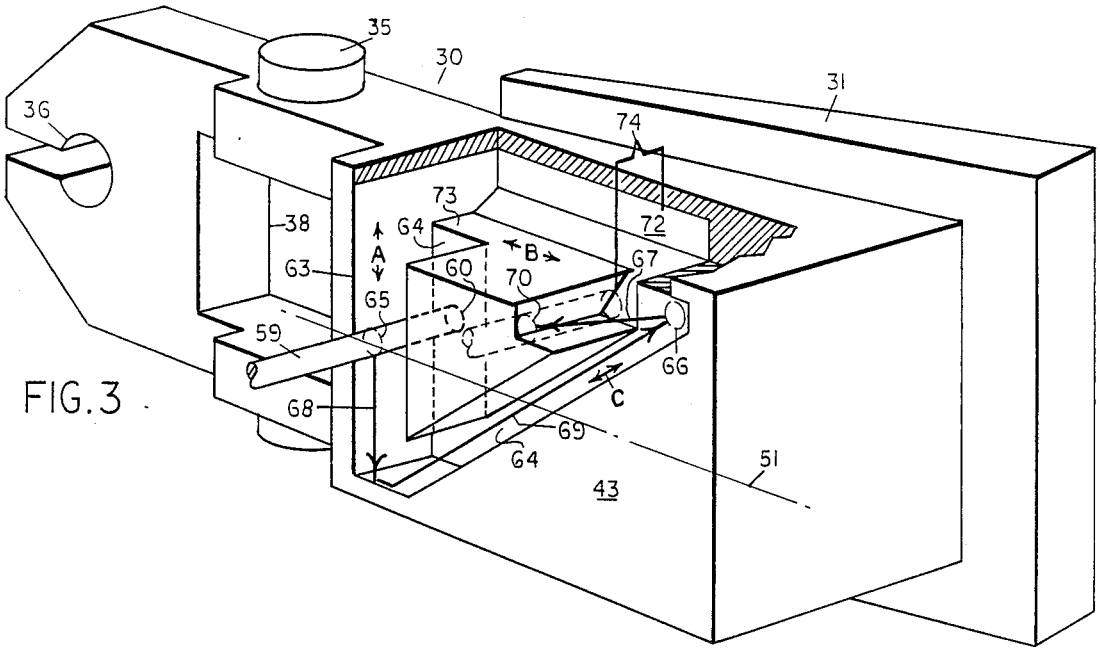
FIG. 3 is a perspective view of the pushbutton per se, shown greatly enlarged and lying on its right-hand side, exposing its pertinent underside portion, portions of which are broken away. A channel formed therein reflects the generally right-angle triangular configuration originally illustrated in Ser. No. 07/164,329. A broken-away portion of the safety spring's probe is shown positioned at its rest position in such channel. Dashed-line circles identity key points within the channel and directional arrows indicate the movement of the probe through the first half of its cycle of operation within the channel.

FIGS. 1 and 2 illustrate a child-resistant disposable lighter embodying the present improvement in a molded plastic housing indicated generally as 15. A portion of the wall structure of the housing 15 forms a fuel compartment 16. Incorporated into or carried by such wall structure are elements many of which are conventional substantially according to the "second type" of disposable lighter referred to under Description of the Prior Art. It is to be understood that such conventional elements form merely a given setting for the portion improved upon; the improvement being applicable to any disposable lighter having a depressible pushbutton. Such conventional elements include valve means having a main body portion 17 communicating with the fuel compartment 16 by means of a tube 17*a*, and a nozzle element 18 movable up and down within the main body portion 17 and biased downwardly by means of a spring (not shown) incorporated within a gear wheel 19 subassembly that is screwed into the main body portion 17 and controls the height of the flame. A user operable flame adjustment lever 20 cooperates with the rear wheel 19, the outer end of the flame adjustment lever 20 extending through a notch 21 provided in a windscreen 22; the inner end of the flame adjustment lever 20 being formed to provide an internally threaded ring 23 that engages the gear wheel 19 to control its rotated position. A column 24 molded integrally with the housing 15 has a bore therein providing support for a flint 25 installed with an underlying spring 26 that maintains the free end of the flint 25 pushed against a flint wheel 27 the rotation of which abrades the flint to produce sparks directed toward the nozzle 18. The housing 15 is molded to include a pair of tabs 28, 29 (tab 28 being sectioned away) for support of the flint wheel 27 and a lever indicated generally as 30 the rearward end of which provides a pushbutton 31. The tabs 28, 29, are provided with a first pair of aligned holes, one of which is seen at 32, into which holes, pivots (one of which is seen at 33) projecting from opposite sides of the flint wheel 27 are snapped; and a second pair of aligned holes, one of which is seen at 34, into which holes, pivots (one of which is seen at 35) projecting from opposite sides of the lever 30 are snapped (the tabs 28, 29, being somewhat flexible to allow such snapped-in attachments). The forward end of the lever 30 is slotted at 36 to permit a snapped-on attachment to a reduced diameter neck portion 37 of the nozzle 18, and the lever 30 is provided with a central opening 38 for operating clearance around the flint support column 24.

All that structure recited in the paragraph immediately above is prior art except that the present improvement provides the lever 30 with a pushbutton 31 that is longer than its conventional counterpart and having its underside modified according to the invention.

Since the valve means illustrated represents that utilized in the "second type" of conventional disposable lighter, it is to be understood that the spring incorporated within the gear wheel subassembly 19 of the valve means not only biases the nozzle 18 downwardly to hold the valve means normally closed, but also, through the engagement between the nozzle 18 and forward end of the lever 30, biases the pushbutton 31 to return (after depression) to the normal elevation shown in FIG. 1.

The present improvement provides the pushbutton 31 normally locked against depression and the housing 15 having an externally accessible safety release member 39 that must be pushed fully inboard and, while held fully inboard, pushed fully rearward and the allowed to return to a given intermediate position, whereas, the pushbutton 31 becomes unlocked and can be depressed in the conventional way simultaneously with rotation of the flint wheel 27.

A rearward portion of the left and right side walls of the housing 15 form left and right side walls 52, 53, of a second compartment 40, FIG. 2; and the rear wall of the housing 15 forms the rear wall 50 of such second compartment 40. The second compartment 40 is sealed off from the fuel compartment 16 (as later specified) and has an open upper end 41.

The improvement provides a vertically elongated safety spring indicated generally as 42 the lower end of which is anchored in the second compartment 40; and provides a channel (later described) formed in the underside of the pushbutton 31, the pushbutton having an underside portion 43 that is free, overhangs and is depressible into the open upper end 41 of the second compartment 40.

For anchorage of the safety spring 42, the lower portion of the interior of the second compartment 40 is formed to provide first and second pairs of opposed wall surfaces forming, together with a bottom wall of the second compartment, a narrow rectangular box indicated generally as 44.

FIG. 2 shows a construction of the second compartment 40 providing such rectangular box in a manner minimizing the fuel storage space lost to the second compartment. Disposable lighters typically include an internal partition that effects a two-sided fuel compartment; such partition extending across the sides and sealing off one end of the lighter but terminating short of either the upper or lower end of the fuel compartment whereby the liquid fuel flows from one side of the partition to the other. Although the present construction is generally based upon the "second type" of disposable lighter which typically provides such partition terminating short of the upper end of its fuel compartment, in this instance, a partition 45 is provided ending short of a lower end member 46 that closes the lower end of the housing 15; the lower end member 46 being molded separately from the housing 15 in order to provide access for one half of a die for forming the various structures within the housing 15 (except for the interior of the second compartment 40 which is formed by the other half of such die). The modifications next described alter the partition 45 so that a portion of it becomes the front wall 47 of the second compartment 40.

Parallel walls 48, 49, spaced apart no more than the thickness of the wire of which the safety spring 42 is made, are provided inside the second compartment 40, extending between the partition 45 and the rear wall 50 of the housing 15; the walls 48, 49, being laterally centered so as to stand on opposite sides of the longitudinal axis 51, having their upper ends graduated into the left and right side walls 52, 53, respectively, of the second compartment 40 and having their lower ends conterminous with the lower end of the partition 45. The walls 48, 49, form the above-referred-to first pair of opposed wall surfaces of the rectangular box 44; the second pair of opposed wall surfaces of the rectangular box 44 being given effect by that portion of the partition 45 and rear wall 50 that extends between the walls 48, 49. Finally, a bottom wall 54 provided extending longitudinally between the partition 45 and rear wall 50 and laterally between the walls 48, 49, seals off the lower end of the second compartment 40 and completes its isolation from the fuel compartment 16. Since the structure just described terminates at an elevation spaced above the lower end member 46 of the lighter's housing 15, the result is provision of additional fuel space on opposite sides of the walls 48, 49, and under the bottom wall 54.

The safety spring 42 is formed from an initially straight length of stiffly flexible, spring steel wire bent to provide a bottom loop indicated generally as 55, a first arm 56 of which is contiguous and stands vertically with the remainder of the safety spring (which extends upwardly into the underside 43 of the pushbutton 31) and the second arm 57 of which diverges from the first and has a free end 58. The safety spring 42 secures permanent anchorage in the second compartment by forced insertion of its bottom loop 55 into the rectangular box 44. The initial divergence between the arms of the bottom loop 55 is such that its second arm 57 must be partially compressed toward its first arm 56 in order to complete insertion into the rectangular box 44 between the partition 45 and rear wall 50. The spacing between the walls 48, 49, is provided close enough to hold the bottom loop 55 as a whole tightly sandwiched therebetween. The arrangement is such that, subsequent to such forced installation, any attempt to withdraw the safety spring 42 will be opposed by the free end 58 of the second arm 57 jamming against the rear wall 50 of the lighter's housing 15.

The upper end of the safety spring 42 is left straight and standing vertically, and it forms a probe 59 that extends into the channel provided in the underside 43 of the pushbutton 31; the probe 59 having a free end 60.

Immediately below the probe 59, the safety spring 42 is bent to form the safety release member 39; the same projecting laterally though a slot 61 provided, in this embodiment, in the left side wall 52 of the second compartment 40.

That portion of the safety spring 42 extending between the safety release member 39 and the first arm 56 of the bottom loop 55 remains straight and forms a stiffly flexible spring portion 62 of the safety spring 42. FIG. 2 shows the safety spring 42 with the probe 59 at its rest position laterally centered within the second compartment 40 near the partition's forward wall 47. The partition 45 is formed such that the front will 47 is inclined away from the spring portion 62 in order to provide clearance therebetween for entry of the affected part of the pushbutton's underside portion 43 into the open upper end 41 between the probe 59 and front wall 47. The spring portion 62 is stiffly flexible for movement longitudinally and laterally within the second compartment 40 in response to corresponding manipulations of the safety release member 39, enabling the probe 59 to be moved likewise away from its rest position and imparting to the probe 59 a strong bias to return to the rest position shown in FIG. 2.

The underside portion 43 of the pushbutton 31 is molded to provide an elongated channel through the length of which the probe will be caused to move in response to pushing the safety release member 39 inboard and rearward. The channel defines a route that must be taken by the probe in traveling from its rest position at a first point in such channel to a second point in the channel located a maximum distance rearward of the first point and laterally spaced apart from the pushbutton's longitudinal axis, such that, when at such second point in the channel, the probe has imparted to it a combined lateral/longitudinal return bias. In addition, the route defined by the channel is such that the probe must move first laterally and then rearwardly as it travels between such first and second points. Obviously, in order to attain such result, the channel must either be L-shaped in its entirety or otherwise include an L-shaped configuration having one portion extending laterally and providing the first point in the channel at which the probe has its rest position, and another portion extending longitudinally rearwardly from one end of the lateral portion so as to provide the second point in the channel located laterally removed from the longitudinal axis of the pushbutton.

Figure 4:
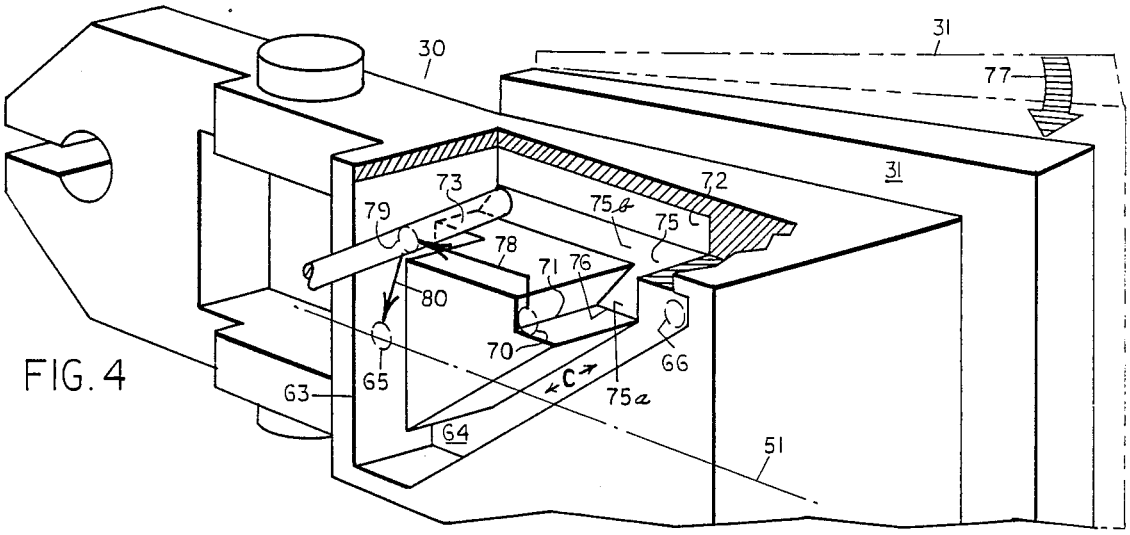
FIG. 4 is a perspective view similar to and duplicating the structure of FIG. 3 and showing the second half of the probe's cycle of operation.

FIGS. 3 and 4 show such essential L-shaped configuration incorporated within a channel indicated generally as 63 forming a closed loop describing a right-angle triangle, wherein, a lateral portion A (that extends perpendicularly across the longitudinal axis 51 within the forward part of the underside portion of the pushbutton) and a longitudinal portion B (that continues from one end of the lateral portion A to the rearward part of such underside portion spaced apart from and parallel to the longitudinal axis 51) are connected together by a diagonal portion C—as first disclosed in the now abandoned application Ser. No. 07/164,329, except that instead of being arranged within the original round-backed styling of the pushbutton, the channel 63 is now arranged within a pushbutton having a square-backed design.

The channel configuration of FIGS. 3 and 4 contemplates movement of the probe in a single direction around the closed loop wherein the probe utilizes the longitudinal portion B only on its return trip to its rest position and accesses the second point in the channel by an indirect route, namely, through the diagonal portion C. Alternative L-shaped and U-shaped channels disclosed herein eliminate the diagonal portion C whereby the probe utilizes the longitudinal portion B both in traveling to and returning from the second point in the channel.

In all configurations of the channel 63, its cross-sectional shape is generally that of an upside-down letter "U" with the connecting arm of the "U" effecting a low ceiling 64, FIG. 3, above the free end 60 of the probe 59. The term "low ceiling" means: in such proximity to the free end of the probe that any attempt to depress the pushbutton 31 is instantly blocked by the low ceiling 64 abutting against the free end 60 of the probe 59.

The appended claims recite certain points of location of the probe within the channel which are common to all configurations of the channel. In FIGS. 3–7, such points of location are identified by dashed-line circles which represent a cross-section of the probe. Since such dashed-line circles are used only to identify points of location they are frequently used alone and, in accordance with where placed, always referred to by numerals unique to that specific point of location. Directional arrows leading from one such dashed-line circle to another indicate the sequence of movement of the probe.

The broad concept of the invention applicable to all configurations of the channel is illustrated in FIGS. 3 and 4, wherein, in response to movement of the safety release member 39 (FIGS. 1, 2) inboard and rearward, the probe 59, FIG. 3, is restricted to a bidirectional route of travel from its rest position at a first point 65, first laterally (arrow 68) and then rearwardly (arrow 69) to a second point 66, whereat, further movement of the probe is stopped and the probe 59 has a combined lateral/longitudinal return bias imparted to it. In the channel configuration of FIG. 3, such rearward movement of the probe is effected through the diagonal portion C which extends across the longitudinal axis 51 and thereby locates the second point 66 laterally removed from the longitudinal axis 51.

However arrived at, all configurations of the channel provide the second point 66 located laterally removed from the longitudinal axis 51 as shown in FIG. 3, whereby, when the safety release member is released, the probe 59 seeks return to its rest position at the first point 65 by moving along a combined lateral/longitudinal return bias path indicated by arrow 67 (which, if extended, would intersect with the first point 65).

All configurations of the channel provide, as shown in FIG. 3, a third point 70 located in the return bias path 67 and provide, at such third point 70, an inside corner 71, FIG. 4, that catches the probe 59 (as indicated by the dashed-line rendition of the probe in FIG. 3) when released from the second point 66.

All configurations of the channel provide a high ceiling segment 72, FIG. 3, located in a longitudinally extending portion of the channel, overhanging the inside corner 71, extending toward the first point 65, and having common boundary with a low ceiling end 73. The term "high ceiling" means: providing clearance over the free end of the probe sufficient to permit the pushbutton to be depressed. Such clearance is indicated in FIG. 3 by the bracket 74. Accordingly, when the probe is caught in the inside corner 71, the pushbutton 31 is unlocked and can be depressed.

All configurations of the channel provide an L-shaped wedge surface indicated generally as 75, FIG. 4, one leg **75*a* of which extends laterally at an angle from an upper end 76 of the inside corner 71 to the high ceiling 72, and the other leg 75*b* of which is longitudinally coextensive with the high ceiling 72**.

FIG. 4 represents the pushbutton 31 depressed (indicated by arrow 77) from its normal elevation (indicated by the phantom lines). When the pushbutton is depressed, the leg **75*a* of the wedge surface 75 drives the probe 59 laterally far enough out of the inside corner 71 to permit the probe to respond to its return bias and move longitudinally on the leg 75*b* far enough to ensure circumvention of the inside corner 71. This lateral/longitudinal movement of the probe is indicated in FIG. 4 by the bent arrow 78, which indicates that the probe has moved from the third point 70 to a fourth point 79 whereat the probe 59 has fully circumvented the inside corner 71 but is stopped by the low ceiling end 73. So long as the pushbutton is held depressed, the low ceiling end 73 prevents the probe from completing its return to its rest position at point 65**.

In all configurations of the channel, when the pushbutton is released and returns to the normal elevation represented in FIG. 3, the corresponding return of the channel to its initial elevation lifts away the obstruction previously presented by the low ceiling end 73 and allows the probe to move (arrow 80, FIG. 4) from the fourth point 79 to its rest position at the first point 65 in the channel—i.e., the probe 59 completes its return to the initial position shown in FIG. 3. The pushbutton is thereby automatically relocked and this occurs instantly upon release of the pushbutton after depression.

The above has described a complete cycle of operation of the probe in terms applicable to all herein-disclosed configurations of the channel.

In order to properly reflect the embodiment originally disclosed, FIGS. 3 and 4 show the high ceiling 72 and leg **75*b* of the wedge surface 75 extending longitudinally to a point laterally adjacent the rest position of the probe, but such length is unnecessary to accomplish the purpose of the high ceiling segment and wedge surface. The high ceiling 72 and leg 75*b* of the wedge surface should extend toward the first point 65 only far enough to ensure that the probe will necessarily circumvent the inside corner and not reenter it as the pushbutton is released. The channel configuration shown in FIGS. 3 and 4** achieves the objects of the invention when held and operated with one hand (whereby the probe is moved around the closed loop as contemplated), but it does not preclude the possibility of diminishing the safety factor by holding the lighter with both hands—one to maintain pressure on the pushbutton, the other to pull the safety release member instead of pushing it as contemplated.

Figure 5:
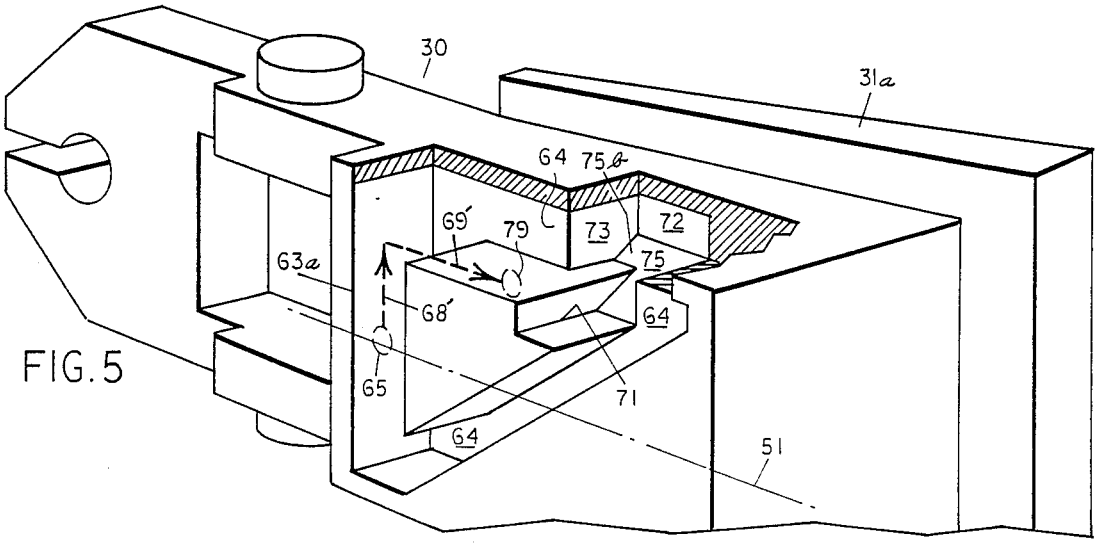
FIG. 5 is a perspective view similar to FIGS. 3 and 4 but correcting the high ceiling segment and wedge surface of the channel so as to shorten same to their necessary length.

FIG. 5 shows an alternative pushbutton **31*a* incorporating a correction of the channel of FIGS. 3 and 4; the corrected channel 63 being in FIG. 5 redesignated 63*a*. Referring to FIG. 5, a shortened length of the high ceiling 72 and leg 75*b* of the wedge surface 75 effects a corresponding increase in the length of that portion of channel 63*a*'s low ceiling 64 that extends from the inside corner 71 to the first point 65. This places the low ceiling end 73 (and thereby the fourth point 79) longitudinally removed from the rest position of the probe. The result is that, if, instead of causing the probe to move laterally in the direction indicated by arrow 68 in FIG. 3, the probe were caused to move laterally in the opposite direction as indicated by the dashed-line arrow 68' in FIG. 5, the probe would still have to be moved longitudinally in the direction of the dashed-line arrow 69', FIG. 5, before the fourth point 79 and thereby the high ceiling 72** would be accessed. In other words, even if attempt were made to move the probe backwards through such closed-loop channel, the probe would still have to be moved bidirectionally before the pushbutton could be depressed. This is an improvement over the arrangement of FIGS. 3 and 4 wherein reverse lateral movement alone would access the high ceiling 72 and under the special conditions described allow the pushbutton to be depressed. Accordingly, the channel 63*a* of FIG. 5 is deemed the best mode of attainment and is the presently preferred embodiment of such closed-loop channel. The alternative pushbutton 31*a* of FIG. 5 incorporating the corrected channel 63*a* is hereby substituted for the pushbutton 31 of FIGS. 3 and 4.

Figure 6:
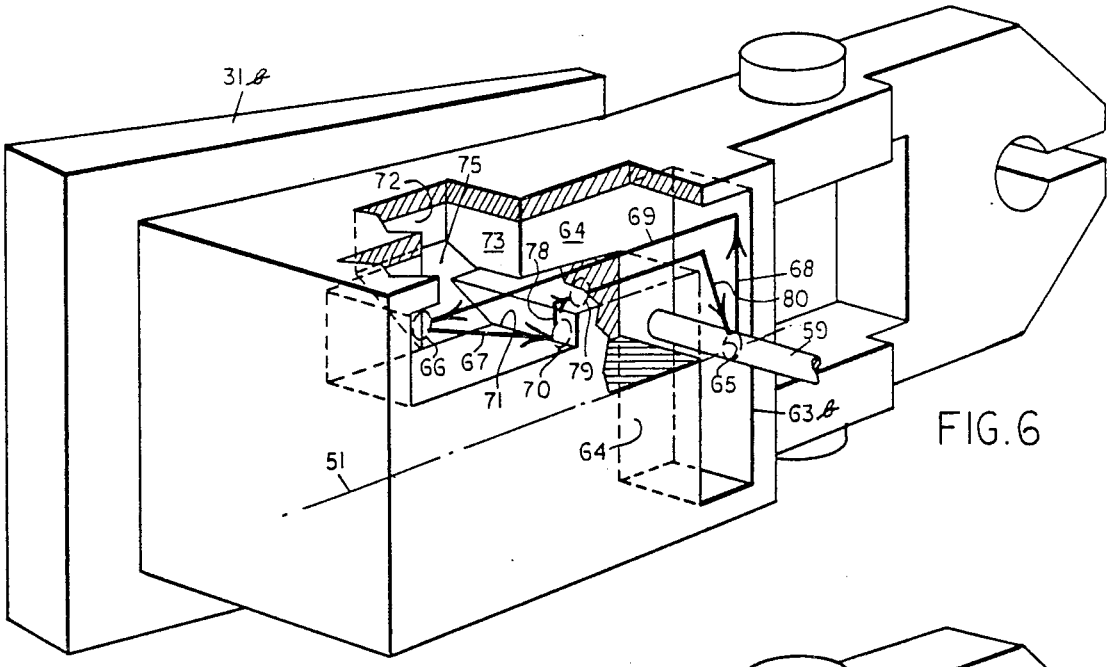
FIG. 6 is a perspective view of an alternative pushbutton usable with the structure of FIGS. 1 and 2, having an L-shaped channel. The pushbutton of FIG. 6 is shown lying on its left-hand side and with portions sectioned or broken away.

FIG. 6 illustrates an alternative pushbutton 31*b* having an alternative L-shaped channel indicated generally as 63*b* that is inherent in the embodiment of FIG. 5, being arrived at by eliminating the diagonal portion of the FIG. 5 channel. FIG. 6 shows the L-shaped channel 63*b* arranged for use with the structure of FIGS. 1 and 2 wherein the safety release member 39 is located at the left side wall 52 of the second compartment 40. In order to show such arrangement of the L-shaped channel 63*b* in the same position as the corresponding portion of channel 63*a*, FIG. 5, from which it is derived, in FIG. 6 the pushbutton 31*b* is shown lying on its left side (i.e., reversed from FIGS. 3, 4 and 5). In FIG. 6, the arrow 68 is, therefore, the same arrow 68 as in FIG. 3, but it now points upwardly because the right-hand side of pushbutton 31*b* is located at the upper portion of FIG. 6. Arrow 68 in FIG. 6, even though pointing upwardly, indicates the same direction of movement of the probe 59 as the arrow 68 in FIG. 3.

Figure 7:
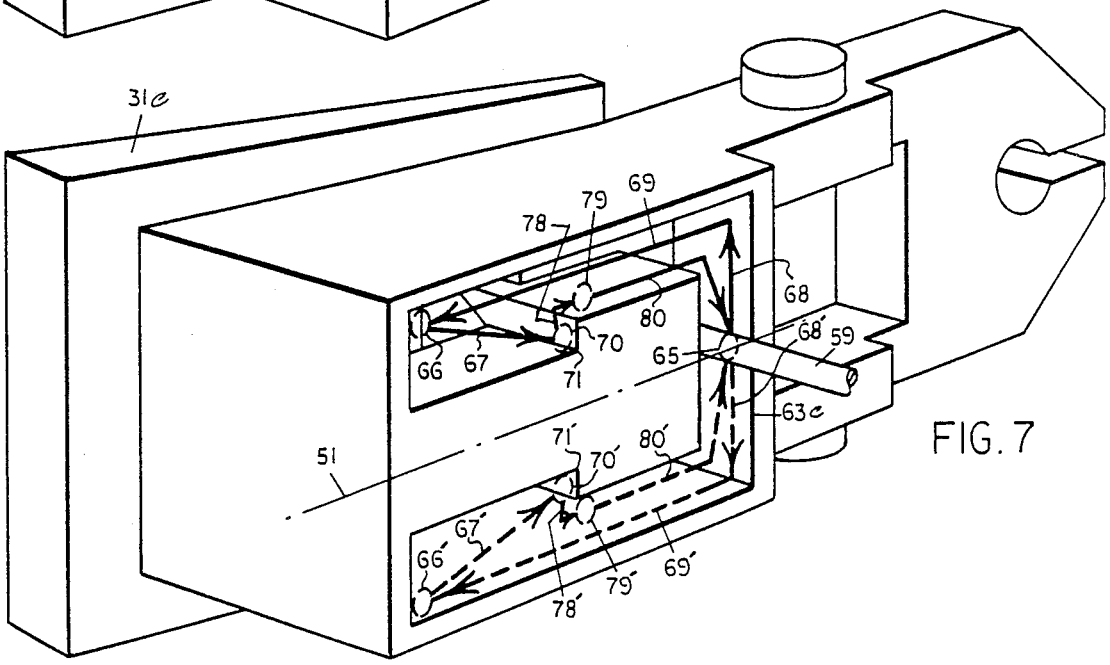
FIG. 7 is a perspective view similar to FIG. 6 of another alternative pushbutton, this one intended for use with alternative embodiments of the invention lighter which provide an opposed pair of safety release members for left-handed/right-handed user convenience; for which application the FIG. 7 pushbutton provides a U-shaped channel which, in effect, duplicates the L-shaped channel of FIG. 6 on opposite sides of the FIG. 7 pushbutton's longitudinal axis.

Before describing the channel 63*b* of FIG. 6 in detail, attention is called to FIG. 7 which illustrates still another alternative pushbutton 31*c* incorporating a U-shaped channel indicated generally as 63*c*—in order to point out its close relationship with the L-shaped channel 63*b* of FIG. 6; the relationship being such that the description provided in connection with FIG. 6 will serve as well to describe either half of the U-shaped channel 63*c* of FIG. 7.

FIG. 7 shows a symmetrical U-shaped channel 63*c* that, in effect, duplicates the L-shaped channel of FIG. 6 along opposite sides of the longitudinal axis 51 of the pushbutton 31*c*, for use with alternative embodiments of the invention lighter which provide left-handed/right-handed user convenience.

That half of the U-shaped channel of FIG. 7 that is located above the longitudinal axis 51 is identical to the corresponding portion of FIG. 6 and forms a right branch of the U-shaped channel of FIG. 7. The solid-line arrows of FIGS. 6 and 7 are the same arrows and describe identical cycles of operation.

That half of the U-shaped channel of FIG. 7 that is located below the longitudinal axis 51 forms a left branch of the U-shaped channel of FIG. 7; such left branch being merely a "mirror reflection" of the right branch, and accordingly, the dashed-line arrows within the left branch are a mirror reflection of the solid-line arrows shown within the right branch.

In view of the above, the description next provided of the L-shaped channel configuration of FIG. 6 applies as well to either half of the U-shaped channel configuration of FIG. 7.

FIG. 6 shows the probe 59 at its rest position at the first point 65 within an L-shaped channel 63*b*. In response to pushing he safety release release member 39 of FIGS. 1 and 2 inboard and rearward, the probe 59 in FIG. 6 moves first laterally as indicated by arrow 68 and then rearwardly as indicated by arrow 69 from the first point 65 to the second point 66. When the safety release member is released, the probe 59 follows the combined lateral/longitudinal return bias path indicated by arrow 67 to the third point 70 whereat the probe is caught in the inside corner 71 and stands under the high ceiling 72. In the same manner as previously described in connection with FIG. 4, when the pushbutton 31*b* of FIG. 6 is depressed (such depression not being shown in FIG. 6), the descension of the wedge surface 75 of FIG. 6 drives the probe laterally out of the inside corner 71 and allows the probe to move in response to its return bias until stopped by the low ceiling end 73. The bent arrow 78 indicates that the probe has moved from the third point 70 to the fourth point 79 which represents the probe in abutment against the low ceiling end 73. When the pushbutton 31*b* is released and the low ceiling 64 thereby returns to its normal elevation, the remaining return bias of the probe causes it to move as indicated by arrow 80 from the fourth point 79 to its rest position at point 65. This paragraph has described the complete cycle of operation of the probe within the L-shaped channel configuration of FIG. 6.

The cycle of operation described immediately above is shown occurring also in each half of the U-shaped channel 63*c* of FIG. 7, which differs from the embodiment of FIG. 6 only in that in FIG. 7 the probe 59 is laterally movable from its centered position at the first point 65 either in the direction of the solid-line arrows, or, in the direction indicated by the dashed-line arrows.

Figure 8:
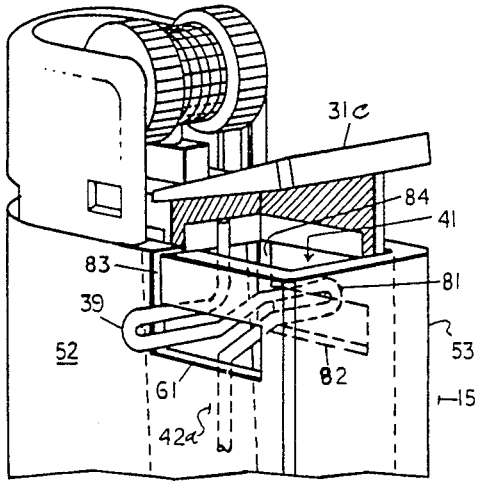
FIG. 8 is a perspective view similar to the upper portion of FIG. 1, showing a first alternative embodiment of the invention lighter providing an opposed pair of safety release members for use with the pushbutton of FIG. 7 for left-handed/right-handed user convenience.

FIG. 8 shows a first alternative embodiment of the invention lighter attaining left-handed/right-handed universality in combination with the pushbutton 31*c* of FIG. 7. An alternative safety spring indicated generally as 42*a* is bent to provide a second safety release member 81 that projects through a second slot 82 provided in the right, side wall 53 of the second compartment the upper end of which is indicated at 41. Cuts 83, 84, in the walls 52, 53, enable insertion of the safety release members 39, 81, into the slots 61, 82, respectively.

Figure 9:
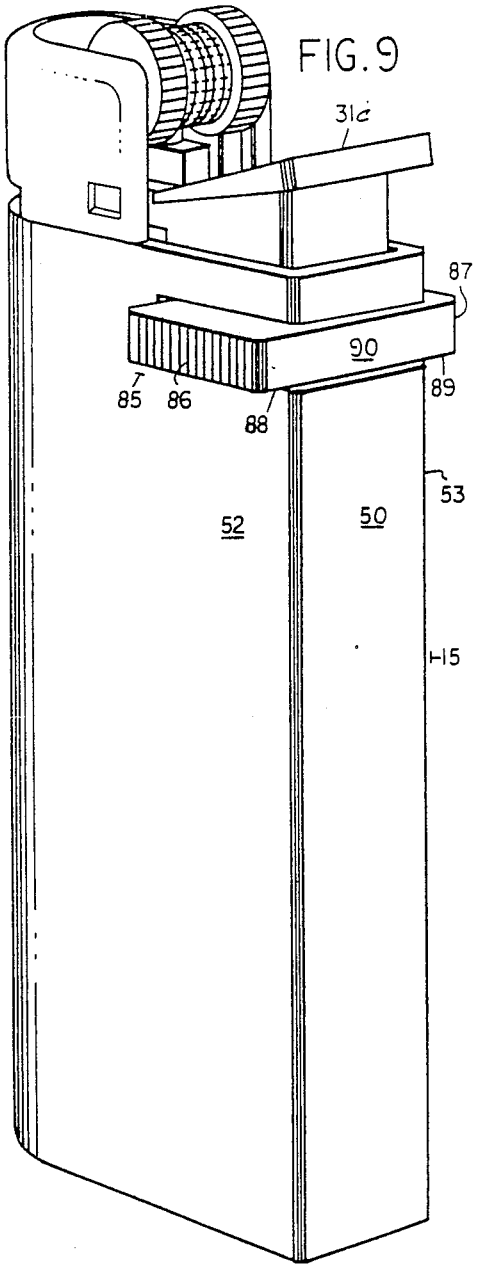
FIG. 9 is a general perspective view of a second alternative embodiment of the invention lighter providing an opposed pair of safety release members for use with the pushbutton of FIG. 7 for left-handed/right-handed user convenience. As indicated above in connection with FIG. 8, except for the modifications next described, all other structure of FIG. 9 is identical to that shown in FIG. 2.

FIG. 9 shows a second alternative embodiment of the invention lighter attaining left-handed/right-handed universality in combination with the pushbutton 31*c* of FIG. 7. A rectangular plastic block indicated generally as 85 forms a double-sided, safety release pushbutton. FIG. 9 shows such safety release pushbutton (i.e. the block 85) assembled and at its rest position. Opposite sides 86, 87, of the block 85 form left and right safety release members in the form of pushbuttons (which may be grooved for improved thumb grip) and extend at 88, 89, beyond the left and right side walls 52, 53, respectively, of the second compartment 40, FIG. 10. A rear side 90 of the block 85 preferably stands normally flush with the rear wall 50 of the second compartment 40.

Figure 10:
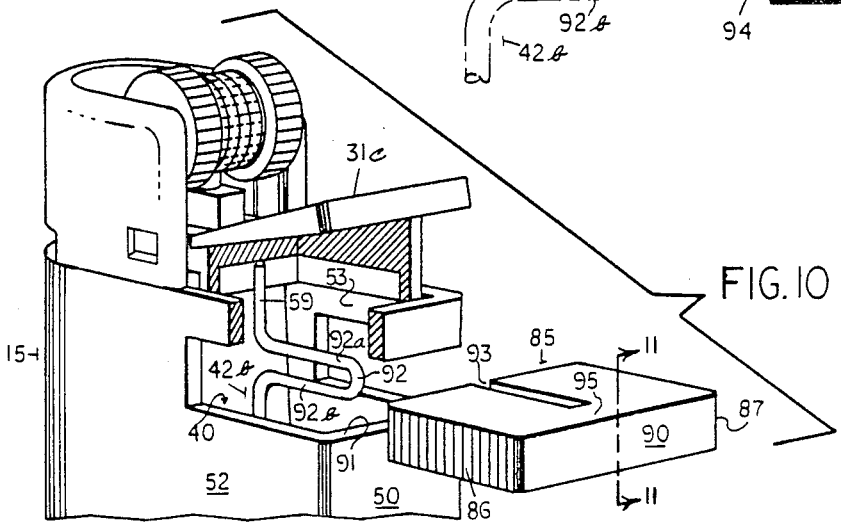
FIG. 10 is a perspective view of the upper portion of FIG. 9, showing the safety release pushbutton in exploded relationship and the modifications made in the safety spring and housing for its acceptance.

Referring to FIG. 10, a notch 91 extends from the left side wall 52, around the rear wall 50 to the right side wall 53 for receipt of the block 85 with operating clearance therebetween. An alternative form of safety spring indicated generally as 42*b* provides an attachment loop 92 that extends toward the rear wall 50 of the second compartment 40 for anchorage of the block 85; the block 85 being provided with a specially formed slit 93 that receives the attachment loop 92.

Figure 11:
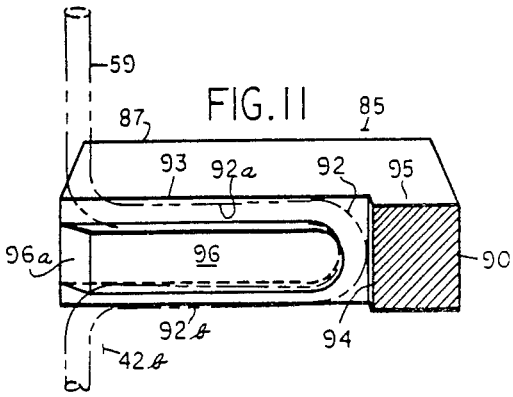
FIG. 11 is an enlarged perspective view of the safety release pushbutton sectioned along a longitudinal plane indicated by the line 11—11 of FIG. 10; phantom lines represent that portion of the safety spring to which the safety release pushbutton secures its snapped-on attachment.

Referring to FIG. 11, which shows the block 85 sectioned on the plane 11—11 of FIG. 10, the slit 93 extends from the front side (hidden, but obviously, opposite the rear side 90) of the block 85 and ends short at 94 so as to leave a rearward portion 95 of the block 85 that can be flexed to spread the slit 93 around the attachment loop 92. The block 85 is molded to provide a boss 96 (beveled at 96*a* to enable the boss 96 to override the rounded end of the attachment loop) within the slit 93 that is shaped to enter into the attachment loop 92 and fit snugly between the spaced apart arms 92*a*, 92*b*, of the attachment loop 92 as shown in FIG. 11, wherein relative dimensions are shown to be such that parallel walls of the slit 93 stand against the arms 92*a*, 92*b*, of the attachment loop 92. The combined effect of the parallel walls of the slit 93, the boss 96, and the slit's end 94, is that the block 85 secures a fixed attachment to the safety spring 42*b* such that any lateral or longitudinal movement of the block 85 will necessarily be transmitted to the probe 59 and vice versa.

Figure 12:
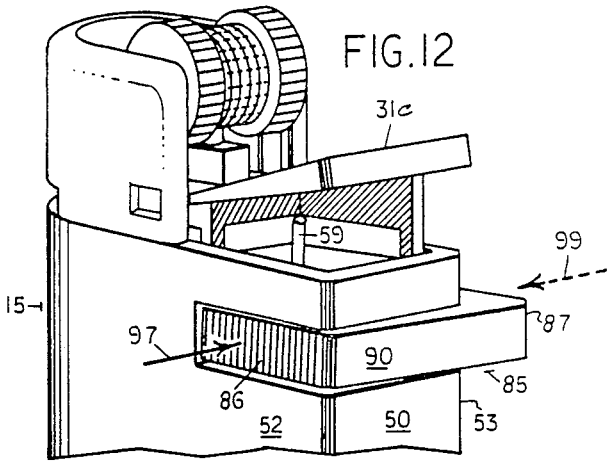
FIG. 12 is a perspective view similar to FIG. 10 but showing the safety release pushbutton installed and pushed inboard toward the right-hand side of the lighter.
Figure 13:
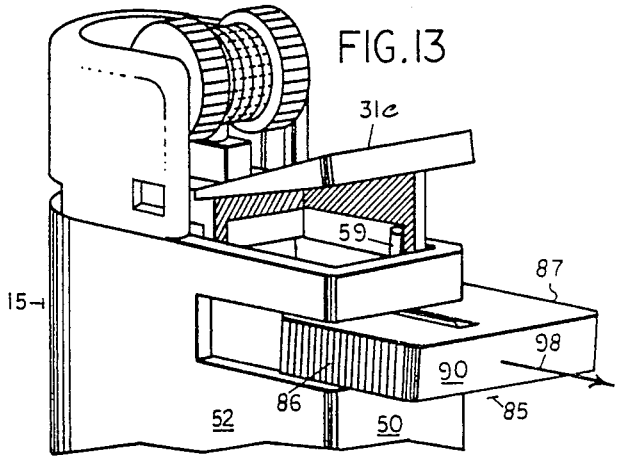
FIG. 13 is a perspective view similar to FIG. 12 showing the safety release pushbutton pushed rearward after movement as shown in FIG. 12.

FIGS. 12 and 13 show consecutive displacements of the block 85 effected by a right-handed person.

A right-handed person uses side 86 of the block 85; pushing it first inboard as indicated by arrow 97, FIG. 12, and then rearward as indicated by arrow 98, FIG. 13; effecting corresponding movements of the probe 59 within that half of the U-shaped channel of FIG. 7 that is located above the longitudinal axis 51 in FIG. 7; i.e., through the right branch of such U-shaped channel.

A left-handed person uses side 87 of the block 85; pushing it first inboard as indicated by the arrow 99, FIG. 12, and then rearward as indicated by arrow 98, FIG. 13; effecting corresponding movements of the probe 59 within that half of the U-shaped channel of FIG. 7 that is located below the longitudinal axis 51 in FIG. 7; i.e., through the left branch of such U-shaped channel.

In each case, once the block 85 is released, the cycle of operation is the same as previously described.

I claim:

1. A child-resistant disposable lighter, including:

a housing comprising wall structure providing a fuel compartment and a second compartment isolated from said fuel compartment and having an open upper end, a portion of said wall structure forming opposed front and rear walls, opposed left and right side walls, and a bottom wall of said second compartment;

said housing providing valve means communicating with said fuel compartment for release of fuel, fuel ignition means, and means providing a pushbutton that is spring-biased to maintain a normal elevation and is depressible to open said valve means for release of fuel, said pushbutton having an underside portion that is free, overhangs and is depressible into said open upper end of said second compartment—said underside portion having a longitudinal axis lying in a plane of symmetry and extending between forward and rearward parts of said underside portion;

and wherein the improvement comprises:

said underside portion being provided with an elongated channel formed therein; said channel including a lateral portion extending perpendicularly across said longitudinal axis within the forward part of said underside portion, and a longitudinal portion continuing from one end of said lateral portion to the rearward part of said underside portion spaced apart from and parallel to said longitudinal axis;

safety spring means provided standing in said second compartment and having a lower portion;

means for anchoring said lower portion of said safety spring means in said second compartment;

said safety spring means having an upper portion forming an upright probe having a free end extending into said channel at a given rest position located within said lateral portion of said channel;

safety release means secured to said safety spring means immediately below said probe for moving said probe within said channel; said safety release means including a thumb-operable safety release member extending laterally relative to said longitudinal axis and outboard of one of said side walls of said second compartment through an opening provided in same;

said safety spring means having a spring portion extending between said safety release member and said lower portion of said safety spring means, said spring portion being stiffly flexible for moving said probe within said channel;

said channel further providing:

a generally low ceiling at such elevation proximate the free end of said probe as to block depression of said pushbutton when said pushbutton is at its normal elevation;

a first point in said channel located at the rest position of said probe;

a second point located in said longitudinal portion furthest from said first point and whereat further rearward movement of said probe is stopped, accessed by the probe in response to inboard and rearward movement of said safety release member, and whereat, said probe has a combined lateral/-longitudinal return bias imparted to it;

a third point located in said longitudinal portion, between said first and second points and in the return bias path of said probe;

an inside corner located in said longitudinal portion at said third point and adapted to catch said probe when released from said second point so as to interrupt return of the probe to said first point;

a high ceiling segment located in said longitudinal portion and providing clearance over the free end of said probe sufficient to permit said pushbutton to be depressed; said high ceiling segment overhanging said inside corner and a fourth point in said channel; said fourth point being located between said third and first points, outside said inside corner and adjacent a low ceiling end having common boundary with said high ceiling segment; and, an L-shaped wedge surface located within and coextensive with said high ceiling segment, having a first leg thereof extending angularly from said inside corner to said high ceiling segment and having a second leg thereof located outside said inside corner and encompassing said fourth point—such that, when said pushbutton is depressed, the first leg of said wedge surface drives said probe laterally out of said inside corner and the second leg of said wedge surface enables the probe to move to said fourth point so as to ensure circumvention of said inside corner, the probe being stopped against further return travel by abutment against said low ceiling end;

the combination being so constructed and arranged that when said pushbutton is released and thereby returns to its normal elevation, said low ceiling end is lifted away and said probe returns to its rest position at the first point in said channel, thereby relocking said pushbutton.

2. A combination as in claim 1; wherein:

said safety spring means is a one-piece element, hereinafter referred to as a safety spring, formed in its entirety from an initially straight length of spring steel wire, for reference purposes positioned vertically so as to have a vertical axis;

said probe and said spring portion are formed by the upper end portion and an intermediate portion, respectively, of said wire, both of which portions are left straight and aligned so as to have said vertical axis in common;

said safety release member is formed by a portion of said wire extending between said probe and spring portion that is bent to form a loop;

the opening in said side wall through which said safety release member extends is a slot provided in said side wall and through which said loop extends, installation of said loop in said slot being effected by flexing said spring portion;

said lower portion of said safety spring is formed by a lower portion of said wire bent to form a bottom loop having a first arm contiguous with said spring portion and a second arm diverging from the first arm and having a free end; and, said means for anchoring comprises structure of said second compartment occupying a lower portion of the interior thereof forming a narrow rectangular box including a first pair of opposed walls that stand spaced apart parallel to each other to slidably receive and hold said bottom loop firmly sandwiched therebetween, and, a second pair of opposed walls cooperating with the first to hold the second arm of said bottom loop partially compressed toward the first arm thereof such that the free end of said second arm is spring biased against one of the walls of said second pair of opposed walls.

3. A combination as in claim 1 wherein said channel forms a right-angle triangular closed loop, a first leg of which comprises said lateral portion, a second leg of which comprises said longitudinal portion and a third leg of which comprises a diagonal portion provided extending between and opening into free ends of said lateral and longitudinal portions; said closed loop being so arranged that, in response to inboard movement of said safety release member, said probe moves laterally toward said diagonal portion, in response to rearward movement of said safety release member, said probe moves through said diagonal portion to said second point in said channel, and, in response to release of said safety release member, return travel of said probe is through said longitudinal portion to its rest position in said lateral portion as recited.

4. A combination as in claim 1 wherein said channel is restricted to an L-shaped configuration comprising in its entirety said lateral and longitudinal portions; said L-shaped configuration being so arranged that, in response to inboard movement of said safety release member, said probe moves laterally toward said longitudinal portion, in response to rearward movement of said safety release member, said probe moves through said longitudinal portion to said second point in said channel, and, in response to release of said safety release member, return travel of said probe is through said longitudinal portion to its rest position in said lateral portion as recited.

5. A combination as in claim 1 providing left-handed/right-handed user convenience; wherein:

said safety release member is located at the left side wall of said second compartment and being hereinafter referred to as a left safety release member;

said safety release means includes a right safety release member extending laterally outboard of the right side wall of said second compartment through an opening provided in same;

said channel is U-shaped, said lateral portion of said channel comprising the central leg of said U-shape and extending equidistant from opposite sides of said longitudinal axis;

said probe has its rest position laterally centered in said lateral portion so that said first point is intersected by said longitudinal axis;

said longitudinal portion of said channel comprises a first leg of said U-shape and is located nearest said right side wall of said second compartment; that half of said lateral portion extending from said longitudinal axis to and together with said longitudinal portion comprising a right branch of said U-shaped channel through which said probe is movable in response to inboard and rearward movement of said left safety release member; and, said channel is provided with a second longitudinal portion duplicating the first, said second longitudinal portion comprising the second leg of said U-shape and being located nearest said left side wall of said second compartment; that half of said lateral portion extending from said longitudinal axis to and together with said second longitudinal portion comprising a left branch of said U-shaped channel through which said probe is movable in response to inboard and rearward movement of said right safety release member.

6. A combination as in claim 5; wherein:

said safety spring means is a one-piece element, hereinafter referred to as a safety spring, formed in its entirety from an initially straight length of spring steel wire, for reference purposes positioned vertically so as to have a vertical axis;

said probe and said spring portion are formed by the upper end portion and an intermediate portion, respectively, of said wire, both of which portions are left straight and aligned so as to have said vertical axis in common;

said left and right safety release members are formed by a portion of said wire extending between said probe and spring portion that is bent to form opposed left and right loops;

the openings in said left and right side walls through which said left and right safety release members extend are distinct left and right slots, through which said left and right loops extend, respectively;

said left and right side walls are provided with left and right cuts extending from the open upper end of said second compartment to said left and right slots to enable insertion of said left and right loops into said left and right slots, respectively;

said lower portion of said safety spring is formed by a lower portion of said wire bent to form a bottom loop having a first arm contiguous with said spring portion and a second arm diverging from the first arm and having a free end; and, said means for anchoring comprises structure of said second compartment occupying a lower portion of the interior thereof forming a narrow rectangular box including a first pair of opposed walls that stand spaced apart parallel to each other to slidably receive and hold said bottom loop firmly sandwiched therebetween, and, a second pair of opposed walls cooperating with the first to hold the second arm of said bottom loop partially compressed toward the first arm thereof such that the free end of said second arm is spring biased against one of the walls of said second pair of opposed walls.

7. A combination as in claim 5; wherein:

said safety spring means is a one-piece element, hereinafter referred to as a safety spring, formed in its entirety from an initially straight length of spring steel wire, for reference purposes positioned vertically so as to have a vertical axis;

said probe and said spring portion are formed by the upper end portion and an intermediate portion, respectively, of said wire, both of which portions are left straight and aligned so as to have aid vertical axis in common;

a double-sided safety release pushbutton is provided having the form of a rectangular block opposed sides of which extend laterally beyond the left and right side walls of said second compartment and form pushbuttons giving effect to said left and right safety release members, respectively; the combination including means to secure said block to said safety spring for movement of said probe within said channel in response to movement of said block laterally alternately in opposite directions and rearwardly within said notch;

the openings in said left and right side walls through which said left and right safety release members extend are opposite ends of a single notch that cuts away the otherwise interconnecting portion of the rear wall of said second compartment, said notch extending deeply enough into the left and right side walls of said second compartment to receive said block;

said lower portion of said safety spring is formed by a lower portion of said wire bent to form a bottom loop having a first arm contiguous with said spring portion and a second arm diverging from the first arm and having a free end; and, said means for anchoring comprises structure of said second compartment occupying a lower portion of the interior thereof forming a narrow rectangular box including a first pair of opposed walls that stand spaced apart parallel to each other to slidably receive and hold said bottom loop firmly sandwiched therebetween, and, a second pair of opposed walls cooperating with the first to hold the second arm of said bottom loop partially compressed toward the first arm thereof such that the free end of said second arm is spring biased against one of the walls of said second pair of opposed walls.

8. A combination as in claim 7 wherein said means to secure said block comprises:

said safety spring being bent between said probe and spring portion to provide an attachment loop that extends toward the rear wall of said second compartment and has spaced apart arms;

said block having front and rear sides and being provided with a slit adapted to receive said attachment loop, said slit extending from the front of said block and ending short of its rear side so as to leave a rearward portion of said block intact to maintain the integrity of said block;

said slit having parallel walls that stand spaced apart and have dimensions suitable to stand tightly against the arms of said attachment loop; at least one of said last-recited walls being provided with a boss shaped to enter into said attachment loop such that said block is thereby stopped against movement in any direction relative to said attachment loop; and, the rearward portion of said block being flexible for snapped-on attachment of said block by spreading said slit to enable said boss to enter into said attachment loop.

* * * * *